US007530472B2

(12) United States Patent
Bitowft et al.

(10) Patent No.: US 7,530,472 B2
(45) Date of Patent: May 12, 2009

(54) WIPES DISPENSING SYSTEM

(75) Inventors: Bruce K. Bitowft, Pleasanton, CA (US); Audy L. Baack, Oakland, CA (US); William Ouellette, Pleasanton, CA (US); Ted Shapas, Pleasanton, CA (US); Joe Timmons, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 600 days.

(21) Appl. No.: 10/870,656

(22) Filed: Jun. 16, 2004

(65) Prior Publication Data

US 2005/0279756 A1 Dec. 22, 2005

(51) Int. Cl.
*B65H 1/00* (2006.01)

(52) U.S. Cl. ..... 221/62; 221/45; 221/63

(58) Field of Classification Search ..... 221/45, 221/63, 62

See application file for complete search history.

(56) References Cited

U.S. PATENT DOCUMENTS 3,982,659 A * 9/1976 Ross ..... 221/63
3,986,479 A * 10/1976 Bonk ..... 118/506
4,235,333 A * 11/1980 Boone ..... 206/233
5,076,465 A * 12/1991 Lawson ..... 221/47
5,531,325 A * 7/1996 Deflander et al. ..... 206/494
5,996,797 A * 12/1999 Flaig ..... 206/494
6,158,614 A * 12/2000 Haines et al. ..... 221/63
6,439,386 B1 * 8/2002 Sauer et al. ..... 206/494
6,578,731 B1 * 6/2003 Lewis et al. ..... 221/46

* cited by examiner

*Primary Examiner*—Patrick Mackey
*Assistant Examiner*—Michael E. Butler
(74) *Attorney, Agent, or Firm*—David Peterson

(57) ABSTRACT

Provided is a wipes dispensing system including a dispenser having a dispensing aperture, a pouch containing an interleaved stack of wipes or a rolled perforated web of wipes contained within the dispenser and accessed through the dispensing aperture, and a mounting element for mounting the dispenser to a mounting surface. The wipes dispensing system may further include a pivotable dispensing lid that closes against the dispensing aperture and seals the wipes from the outside environment when the wipes dispensing system is not in use.

18 Claims, 8 Drawing Sheets

WIPES DISPENSING SYSTEM

BACKGROUND OF THE INVENTION

1. Field of the Invention

This invention relates generally to wipes dispensers, and, more specifically, to a wipes dispensing system including a mounting element releasably mountable to fixed surface. The wipes dispensing system provides for easy dispensing of wipes in a variety of environments and in various orientations of the dispenser.

2. Description of the Related Art

Dry, wet or partially wetted cleaning wipes are known in the art. Other similar sheet-like substrates such as towels, sponges, pads, napkins, diapers etc are also known in the art.

Such items have been packaged in a number of different ways. For example cleaning wipes, tissues, napkins, etc. are often packaged in a standard dispenser box, sometimes with a removable or hinged lid. Such packaging, however, raises the problem of locating, grasping and removing the first substrate at the front of the dispenser package from an aperture in the package.

This problem has been addressed in the prior art by stacking the individual wipes or other substrates horizontally, interweaving each of the substrates with the preceding and subsequent substrate, sometimes referred to as interleaving the wipes. For example, containers or dispensers for wet wipes have been available wherein each of the wet wipes stacked in the container has been arranged in a folded configuration such as a c-folded, z-folded or quarter-folded configuration well known to those skilled in the art. A web of perforated wipes, formed as a roll and separated at the dispenser when needed, has also been used to address this problem.

By stacking the substrates or by using a perforated roll of wipes, when the user removes a substrate, the next substrate may be made to "pop-up" to be easily grasped the next time a wipe is needed. However, these "pop-up" dispensing systems can only be successfully used when the substrate is sufficiently flexible and where the aperture through which the wipes are dispensed offers sufficient resistance to avoid "roping" of the interleaved wipes or perforated wipes. If the dispensing aperture does not sufficiently resist the removal of a wipe, the interleaving of the wipes causes multiple wipes to be dispensed, i.e. the wipes "rope". Roping in a rolled web of perforated wipes is also possible when insufficient force at the dispenser aperture allows multiple wipes to dispense without singulation of the wipes at the wipes separation perforations.

In the prior art, dispensing aperture resistance was accomplished by providing the dispensing aperture as a narrow slit. The narrow slit contacted the wipes during dispensing, thus providing a resistance while dispensing a wipe. However, with a narrow slit, a user could not easily grasp the front wipe to thread the wipe through the aperture for dispensing.

Accordingly, there is a need for improved structures and processes for the dispensing of wipes.

SUMMARY OF THE INVENTION

In accordance with one aspect of the present invention, a releasably mountable wipes dispensing system is provided. The wipes dispensing system includes a dispenser which defines an interior space configured to receive a pouch containing a stack or web of wipes. In one embodiment, the stack or web of wipes is disposed within the interior space directly and the pouch containing the wipes is eliminated. The wipes dispenser has a back attachment surface for attaching the dispenser to a mounting element. The mounting element, and thus the wipes dispenser, is attachable in a variety of orientations and to a variety of fixed mounting surfaces, such as, for example, a wall, the door or bottom surface of a cabinet, a mirror surface, the under-counter surface of a counter top, etc. In one embodiment, the wipes dispenser is releasably mounted to a surface by means of stretch release adhesive tape. The stretch release tape may have a range of dimensions as well as a range of adhesive formulations.

The dispenser includes a dispensing aperture that is oriented substantially parallel to the attachment surface of the dispenser, and which is configured to provide easy and reliable dispensing of single wipes from a stack of wipes contained in the dispenser. The dispensing aperture is covered by a dispensing lid that pivots opens for easy access to the interior of the dispenser.

In one embodiment, a pop-up stack of wipes, which is typically packaged in a flexible pouch, is placed in a pouch space in the interior of the dispenser. Wipes may also be disposed directly in the interior of the dispenser without the use of a pouch. In one embodiment having a pouch, the pouch includes a pouch aperture cut out through the front of the pouch to the stack of wipes. A removable adhesive label covers the aperture to prevent contamination of the wipes prior to use and to prevent dryout of wet wipes. In other embodiments, the wipes stack can be non-pop-up, or can be provided on a roll, where the wipes are connected consecutively in a perforated web.

In use, the in one embodiment is inserted into the interior pouch space of the dispenser via a refill door that pivots opens from a base of the dispenser. In one embodiment, this refill door is configured with a refill door holder that limits the extent to which the refill door can open to about 35 degrees. The refill door holder allows a user to place the pouch into the container using only one hand (i.e., there is no need to hold the front face of the door open while placing the pouch into the container).

A variety of wipe substrates and wet formulations can be used with the dispenser. Wipes may be of a variety of dimensions, substrate densities, folded stack dimensions, wipe-stack counts or stack weights. The dispenser may be used with dry, wet or partially wetted wipes.

A variety of attachment means is possible. The wipes dispenser of the present invention may be releasably mounted to a fixed surface by mounting elements, such as, for example, velcro tapes, suction cups, magnets, screws, removable double-sided foam or other tapes, micro suction, static cling films or by means of a removable mounting bracket. Further, a variety of dispenser attachment orientations is possible, such as, for example, on a wall, with the longer dispenser dimension oriented either parallel, vertical or slated to the ground. The dispenser may also be mounted with the dispensing aperture oriented perpendicular to the mounting surface, such that the wipes are dispensing in a parallel orientation to the mounting surface. The dispenser could also be mounted "upside down", i.e., under an overhead kitchen cabinet.

The dispenser may, be attached to a variety surfaces, such as, for example, painted surfaces, tile, finished wood, particleboard, etc. The present invention is sufficiently flexible to fit in a variety of environments, including high humidity environments, such as bathrooms or near kitchen sinks, or environments subject to low temperatures, such as garages and outdoor work/tool sheds.

Thus, by the present invention, a user may conveniently place, load, and extract wipes wherever and whenever generally needed or useful. Further, the wipes dispensing system may be releasably mounted such that wipes may be dispensed from any direction and from a variety of orientations chosen by the user. Finally, the wipes dispenser system may be easily removed or relocated when desired.

BRIEF DESCRIPTION OF THE DRAWINGS

The foregoing aspects and others will be readily appreciated by the skilled artisan from the following description of illustrative embodiments when read in conjunction with the accompanying drawings, wherein:

FIG. 1G shows a back plan view of the wipes dispensing system shown in FIG. 1A, taken toward a base outside surface from the back of the a base.

Reference will now be made to the drawings wherein like numerals refer to like parts throughout.

DETAILED DESCRIPTION

Figure 1A:
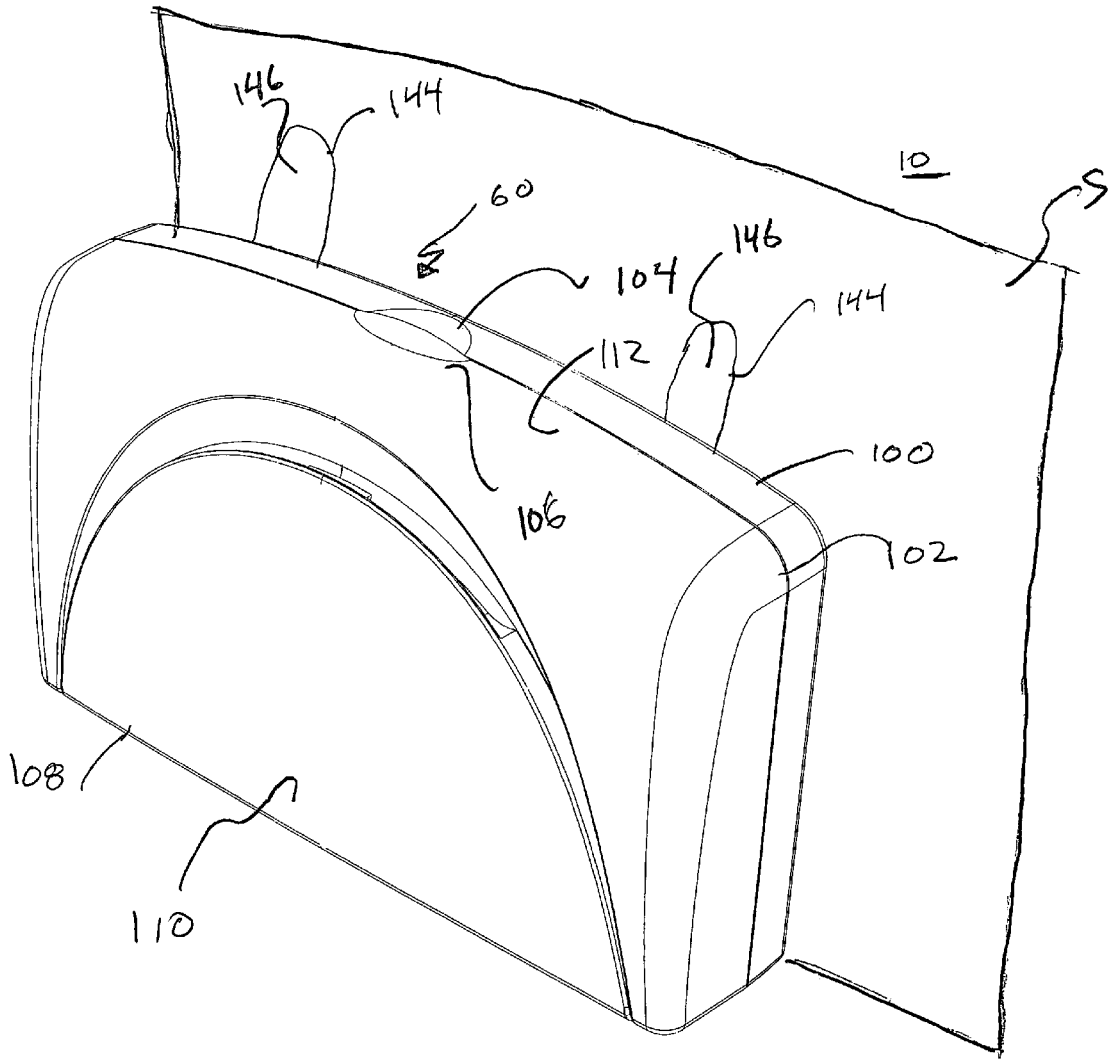
FIG. 1A shows a perspective view of an embodiment of a wipes dispensing system having a base and a dispensing lid in a closed position.

In accordance with the principles of the present invention, provided is a wipes dispensing system that releasably mounts to a mounting element, where the mounting element releasably attaches to a mounting surface. The wipes dispensing system provides for convenient and easy dispensing of wipes in a variety of environments and in various orientations of the wipes dispensing system.

The wipes dispensing system of the present invention includes a dispenser comprising a base and a refill door pivotably coupled to the base. When the refill door is pivoted to a closed position relative to the base, a pouch space is defined by the base and the refill door.

The wipes dispensing system of the present invention further includes a replaceable pouch, which contains a stack of singulated folded wipes or a web of perforated wipes. In use, the refill door of the dispenser is pivoted to an open position relative to the base. A pouch is placed between the base and the refill door. When the refill door is next pivoted to a closed position relative to the base, the pouch, and web or stack of webs contained therein, is enclosed within the pouch space. When the pouch is properly aligned within the dispenser, a pouch aperture in the pouch is aligned with a refill door aperture in the refill door. Thus, wipes are grasped by a user and are simultaneously withdrawn through the pouch aperture and through the refill door aperture. The refill door aperture on the refill door is large enough to allow threading of the first wipe by grasping the first wipe through the refill door aperture and pouch aperture.

In one embodiment, a dispensing lid coupled to the refill door is pivoted to a closed position relative to the refill door to seal the refill door aperture when the wipes dispensing system is not in use. When it is desired to access wipes in the pouch or the stack or web of wipes disposed directly within the interior of the dispenser, the dispensing lid is pivoted to an open position relative to the refill door, thereby making wipes in the pouch accessible through the refill door and pouch apertures.

When all the wipes in the pouch are removed and used, the refill door is pivoted open and the empty pouch removed from the dispenser. A new pouch is placed between the base and the refill door and the refill door is pivoted closed, thereby enclosing the new refill pouch within the pouch space.

The wipes dispensing system of the present invention may be released from the mounting element when it is no longer desired or when it is to be moved. The mounting element is removed from the mounting surface. The dispensing system may be remounted and reattached to a new mounting surface if desired. In one embodiment, the dispenser includes hooks on each of its lateral ends that hang onto the sides of a paper towel dispenser. The hooks are of sufficient length that the wipes dispenser fits under a full roll of paper towels. In this embodiment, the dispenser may be easily removed when no longer desired. In an alternate embodiment, the wipes dispensing system may be permanetly mounted to a mounting surface with, for example, permanent high tack adhesives, screws, permanently attached brackets, and the like.

More particularly, FIG. 1A shows a perspective view of one embodiment of a wipes dispensing system 10, with a dispensing lid 108 in a closed position. Wipes dispensing system 10 includes a dispenser 60, a pouch 130 (FIG. 1C), and a mounting element such as stretch release tape 144. Dispenser 60 includes a base 100. As described more fully below with reference to FIG. 1C, a refill door 102 is, in one embodiment, pivotably coupled to base 100 such that refill door 102 may be placed in a closed position relative to base 100 (FIG. 1A), or refill door 102 may be placed in an open position relative to base 100 (FIG. 1C).

Coupled to base 100 is a refill door latch hook 104 adapted to abuttingly contact and cooperate with a refill door latch contact 106 coupled to refill door 102, to releasably lock refill door 102 with base 100 whenever refill door 102 is pivoted to establish a closed relationship with base 100. In other embodiments, methods other than the abutting contact between refill door latch contact 106 and refill door latch hook 104 established by pivoting refill door 102 to base 100, may be adapted to releasably lock refill door 102 in a closed relationship with base 100. For example, base 100 and refill door 102 may be separate and uncoupled and may be releasably locked in a closed relationship merely by snapping together base 100 and refill door 102. Any manner of releasable fitment or fastening elements well known to those of skill in the art may be used to releasably lock refill door 102 with base 100.

As shown in FIG. 1A, dispenser 60 further includes a dispensing lid 108 having a dispensing lid outside surface 110. Dispensing lid 108 is pivotably coupled to a refill door outside surface 112 of refill door 102, such that, dispensing lid 108 may be placed in a closed position relative to refill door 102, or, alternatively, that dispensing lid 108 may be placed in an open position relative to refill door 102. In one embodiment, dispensing lid 108 is pivotably coupled to refill door 102 by means of a pin and hole configuration well known to those of skill in the art. However; it is envisioned that any means of pivotally coupling the dispensing lid 108 to the refill door 102 may be used in the present invention.

Figure 1B:
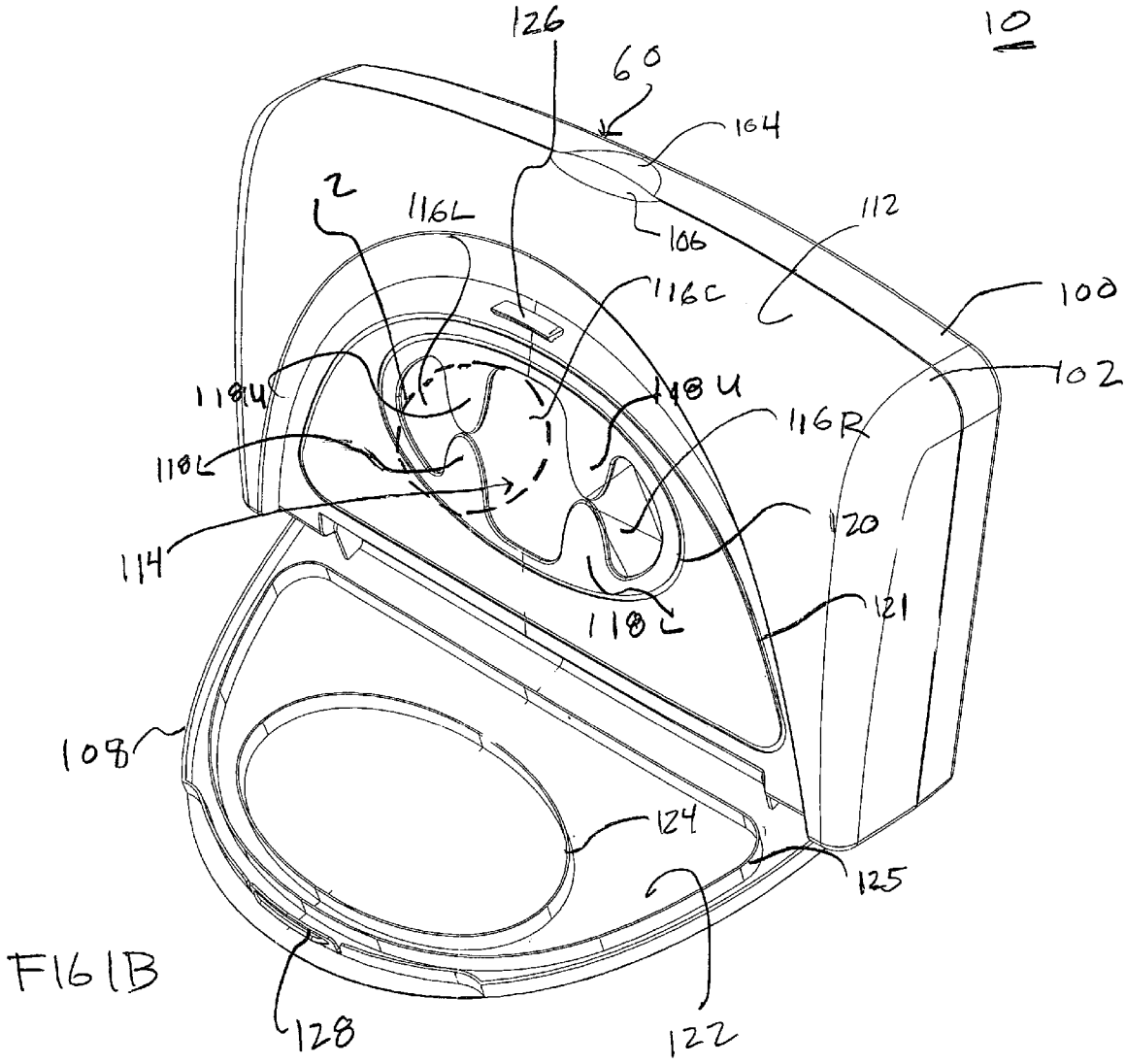
FIG. 1B shows a perspective view of the embodiment of the wipes dispensing system shown in FIG. 1A, but with the dispensing lid pivoted in an open position.
Figure 1C:
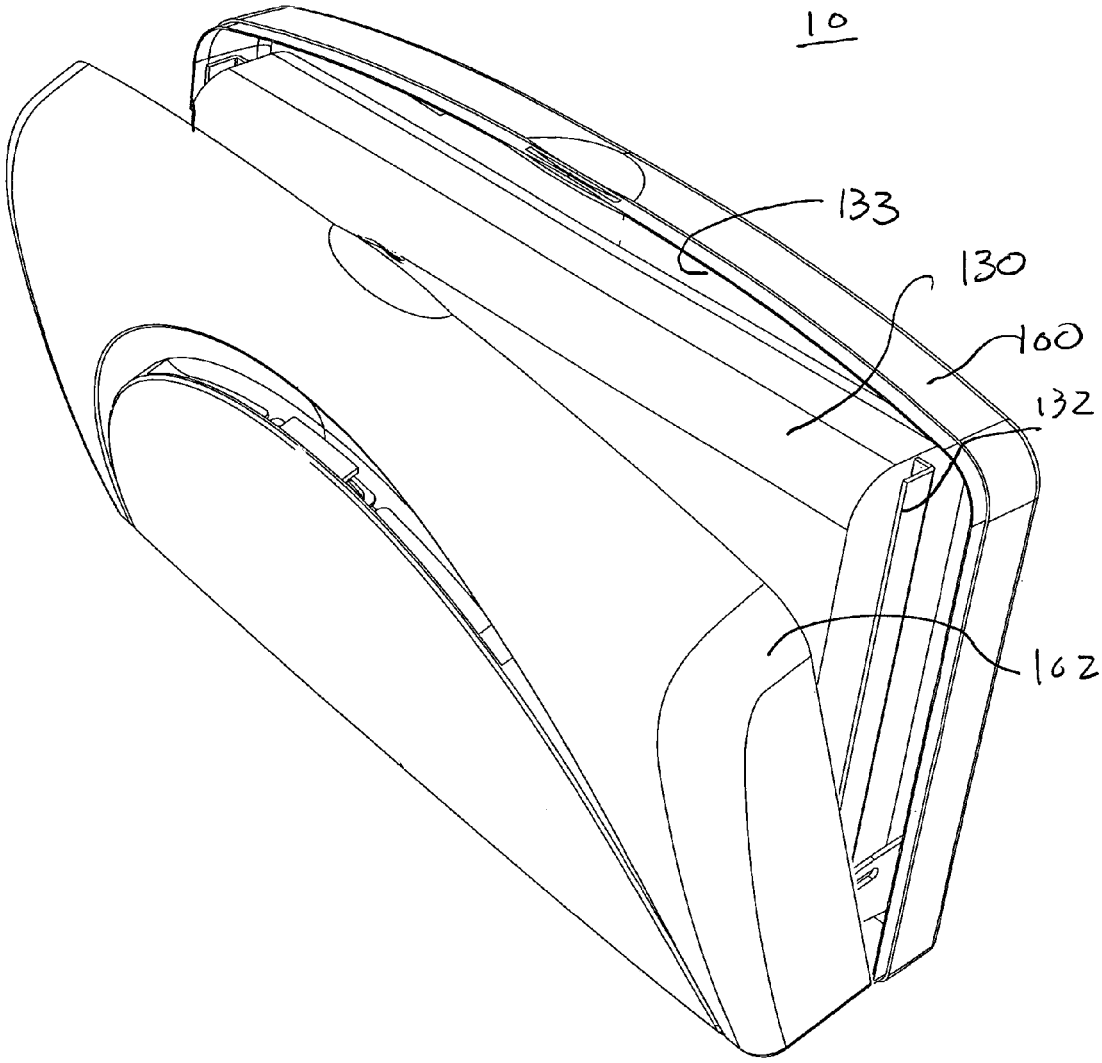
FIG. 1C shows a perspective view of the embodiment of the wipes dispensing system shown in FIG. 1A, with a refill door in an open position.

FIG. 1B shows a perspective view of the embodiment of the wipes dispensing system 10 shown in FIG. 1A, but with dispensing lid 108 pivoted in an open position. Refill door 102 defines a refill door aperture 114. Refill door aperture 114 includes a center lobe 116C and two or more side lobes. In communication with 116C at one side of 116C is a left side lobe 116L. In communication with 116C, at an opposite side of 116C from 116L, is a right side lobe 116R. In this embodiment, refill door aperture 114 is advantageously configured such that a user may readily grasp the front wipe closest refill door aperture 114 from a stack or web of wipes (not individually shown) contained in a pouch 130 (FIG. 1C) or directly disposed within the interior of dispenser 60 without the need to thread wipes through refill door aperture 114.

In other embodiments, refill door aperture 114 may have shapes other than the three-lobe configuration shown in FIG. 1B. For example, refill door 102 may define a single-lobed refill door aperture 114 with an oval, round, rectangular or square shape. The shape of the refill door aperture 114 is configured such that a user may readily grasp the front wipe, of a stack or web of wipes, which is closest to the refill door aperture 114, without the need to thread wipes through refill door aperture 114. Other configurations of refill door aperture 114 will be readily apparent to those of skill in the art, and so are not discussed further to avoid detracting from the presentation of the present invention.

In one embodiment, refill door 102 further defines a pair of appendages, sometimes called upper, (e.g. first), grippers 118U, projecting inward from the upper outside edges of refill door aperture 114 toward its center. Refill door 102 further defines another-pair of appendages, sometimes called lower, (e.g. second), grippers 118L. Each gripper 118L projects inward from the lower outside edge of refill door aperture 114 toward its center. Each lower gripper 118L is opposite a corresponding one of the pair of upper grippers 118U. As described more fully below with reference to FIG. 2, each corresponding pair of upper grippers 118U and lower grippers 118L defines a gap 270 through which wipes pass when extracted from wipes dispensing system 10.

As shown in FIG. 1B, circumscribing refill door aperture 114 is a series of one or more grooves. An inner groove 120 is formed as a depression indented into refill door outside surface 112. Also, circumscribing refill door aperture 114, at a distance from refill door aperture 114 greater than the distance where inner groove 120 is formed, is an outer groove 121. Outer groove 121 is likewise formed as a depression indented into refill door outside surface 112. In other embodiments, more or fewer than two depressions or grooves may be formed in refill door outside surface 112.

One or more interfaces are formed by contacting rings, which are configured as ridges along the dispensing lid inside surface 122, with corresponding grooves. These interfaces, formed from rings and corresponding grooves, seal the refill door aperture 114 and prevent moisture loss from wet or partially wetted wipes whenever dispensing lid 108 is closed on refill door 102. An inner ring 124, is coupled to a dispensing lid inside surface 122 of dispensing lid 108 opposite dispensing lid outside surface 110 (FIG. 1A) of dispensing lid 108. Inner ring 124 is configured as a ridge projecting away from dispensing lid inside surface 122. Inner ring 124 is adapted to abuttingly contact, mate, and cooperate with inner groove 120 to form an inner interface (not shown) whenever dispensing lid 108 is placed in a closed relationship with refill door 102 (as shown in FIG. 1A). This inner interface seals refill door aperture 114 from the outside environment at refill door outside surface 112. An outer ring 125 is coupled to dispensing lid inside surface 122. Outer ring 125 is likewise configured as a ridge projecting from dispensing lid inside surface 122. Outer ring 125 is adapted to abuttingly contact, mate and cooperate with outer groove 121 to form an outer interface (not shown) further sealing refill door aperture 114 from the outside environment at refill door outside surface 112 whenever dispensing lid 108 is placed in a closed relationship with refill door 102.

In other embodiments, more or fewer than two rings may be coupled to dispensing lid inside surface 122 to abuttingly contact, mate and cooperate with corresponding grooves to form more or fewer than two interfaces sealing refill door aperture 114 from the outside environment at refill door outside surface 112 whenever dispensing lid 108 is placed in a closed relationship with refill door 102. Moreover, it is envisioned in further embodiments that the one or more grooves, e.g. grooves 120, 121, may be formed on the dispensing lid inside surface 122, while the one or more rings, e.g. rings 124, 125, may be formed on the refill door outside surface 112 to create the interfaces sealing refill door aperture 114 from the outside environment at refill door outside surface 112 whenever dispensing lid 108 is placed in a closed relationship with refill door 102.

Similarly, as described above with reference to refill door latch hook 104 and refill door 102 (and as shown in FIG. 1B.), coupled to dispensing lid 108 is a dispensing lid latch hook 126 adapted to abuttingly contact and cooperate with a dispensing lid latch contact 128 coupled to refill door outside surface 112 of refill door 102, to releasably lock dispensing lid 108 closed with refill door 102 whenever dispensing lid 108 is placed in closed relationship with refill door 102.

FIG. 1C shows a perspective view of the embodiment of wipes dispensing system 10 shown in FIG. 1A, with refill door 102 in an open position. In one embodiment, refill door 102 is pivotable relative to base 100 by means of a living hinge (not shown), well known in the art, thus allowing base 100 and refill door 102 to be integrally formed in one piece. In another embodiment, refill door 102 is pivotable relative to base 100 by any hinged means, such that refill door 102 and base 100 are formed in two or more pieces and joined along the hinge means. Refill door 102 and base 100 may be formed, integrally or separately, from a variety of materials, such as, for example, polypropylene (PP), high density polyethylene (HDPE), polyethylene terephthalate (PET), polystyrene (PS), acrylonitrile—butadiene—styrene (ABS), and other engineered plastics, and may be formed with a variety of fabrication technologies, such as, for example, thermoforming. The other components of dispenser 60 may be similarly formed.

A pouch 130, containing a web or stack of wipes (not individually shown), is positioned between refill door 102 and base 100. When refill door 102 is next placed in a closed relationship with base 100, pouch 130 is enclosed with the pouch space defined by base 10.0 and refill door 102. In another embodiment, wipes may be disposed directly within the interior of dispenser 60 without a pouch 130.

In one pouch embodiment, pouch 130 includes a slider 132 on each of the left and right lateral sides of pouch 130. A pair of tracks (not shown) on a base inside surface 133 of base 100 is adapted to slidably receive pouch 130 at each slider 132. When fully engaged in the tracks, pouch 130 is secured within the pouch space defined by base 100 and refill door 102 when refill door 102 is closed. In this manner, pouch 130 is secured to base 100 and advantageously remains in place, within the pouch space defined by refill door 102 closed to base 100, whenever a user extracts a wipe contained in pouch 130.

Other means of securing pouch 130 to base 100 will be readily apparent to those of skill in the art. For example, pouch 130 may be secured to base 100 by means of mating fitment elements, velcro tapes, suction cups, magnets, removable double-sided foam or other tapes. Such means of securing pouch 130 may be placed at the left and right lateral edges, top or bottom edges or back surface of pouch 130. In another embodiment, the left and right lateral sides of pouch 130 are formed as gusseted edges, i.e., folded inward upon themselves, to allow a tighter fit of pouch 130 into the pouch space defined when refill door 102 is closed with base 100. The top and bottom edges of pouch 130 may be similarly formed.

Figure 1D:
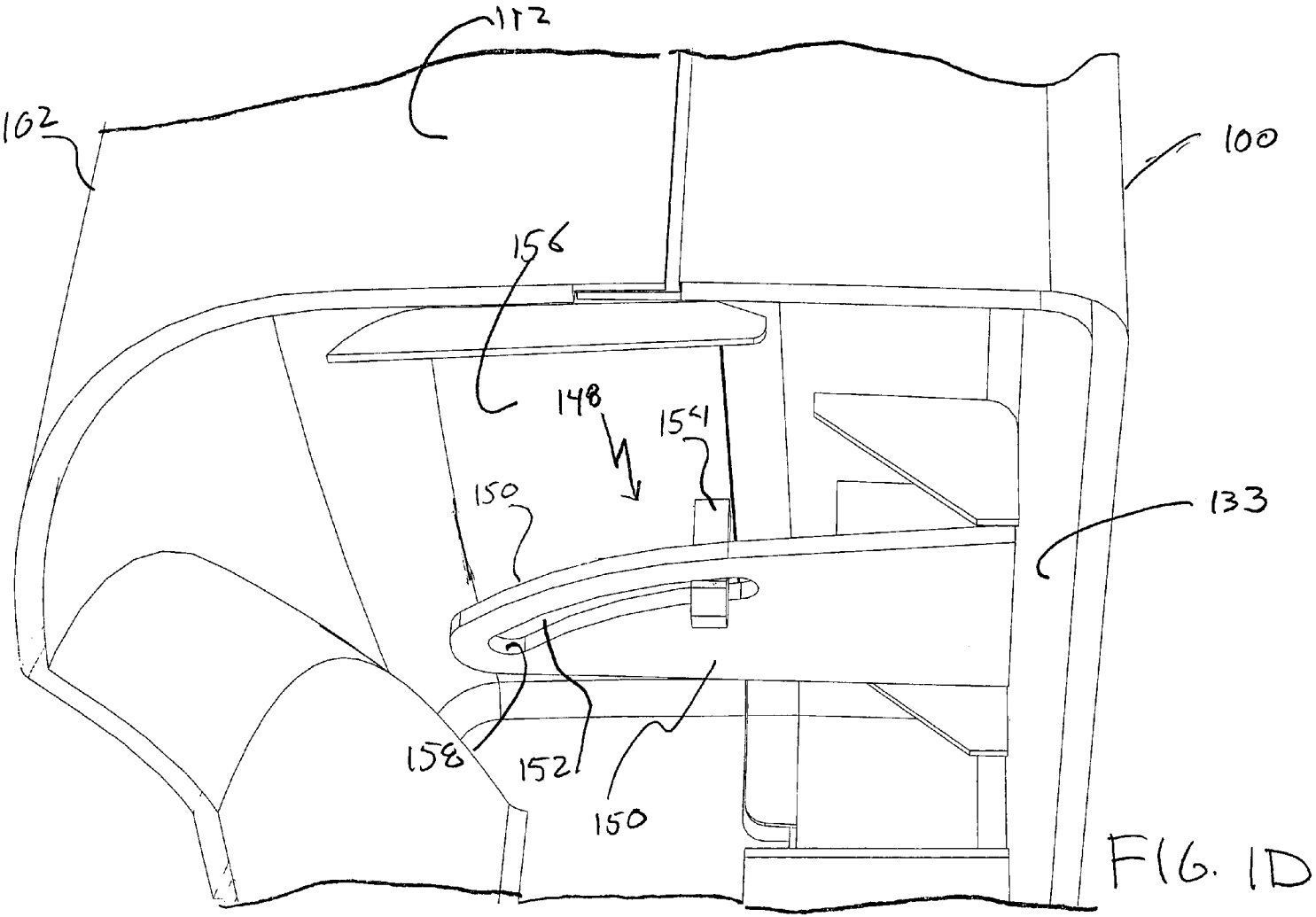
FIG. 1D is a cut-away side view of wipes dispensing system 10 showing a refill door holder.

FIG. 1D is a cut-away side view of wipes dispensing system 10 showing a refill door holder 148 within the pouch space defined by base 100 and refill door 102. In one embodiment, refill door holder 148 limits the extent to which refill door 102 can pivot open relative to base 100 to about 35 degrees.

Refill door holder 148 includes a guide 150 coupled to base inside surface 133 of base 100. Guide 150 is configured generally as a plate-like projection, longitudinally directed away from base inside surface 133 toward refill door 104. Guide 150 includes a slot 152 adapted to cooperated with a pin 154 coupled to a refill door inside surface 156 opposite refill door outside surface 112 (FIG. 1A).

Slot 152 is configured as an arced, slit-like aperture through guide 150 from one plate surface of guide 150 to the opposite plate surface of guide 150 and having an arc angle of about 35 degrees. Pin 154 is configured as a shaft-like projection longitudinally directed away from refill door inside surface 156 toward guide 150. Pin 154 is positioned on refill door inside surface 156, and the size of pin 154 is selected, such that, pin 154 passes through and beyond slot 152 of guide 150 when refill door 102 is closed against base 100.

When refill door 102 is pivoted by a user of dispenser system 10, to open refill door 102 and insert pouch 130 (FIG. 1C), pin 154 moves within slot 152 following the arced path of slot 152. As refill door 102 pivots, pin 154 rotates until a slot lower extent 158 of slot 152 is reached. At this point, slot lower extent 158 constrains pin from further rotational motion within slot 152 relative to base 100. Thus, refill door 102, to which pin 154 is coupled, is likewise constrained from further opening by pivotal rotation relative to base 100. In horizontal and vertical mounting configurations, pin 154 rests at slot lower extent 158 of slot 152 when the user releases refill door 102 after opening. Thus, refill door holder 154 allows a user to place the pouch into the container using only one hand (i.e., there is no need to hold the refill door 102 open while placing pouch 130 (FIG. 1C) within the pouch space defined by base 100 and refill door 102.

In one embodiment two guides 150, one at each side of dispenser system 10, are used to limit the opening of refill door 102. Further, other means of limiting the opening or refill door 102 are possible. For example, the extent of pivotal rotation of refill door 102 may be limited with suitable length straps, elastomeric cords, or coil springs attached at one end to refill door 102 and at the other end to base 102.

Figure 1E:
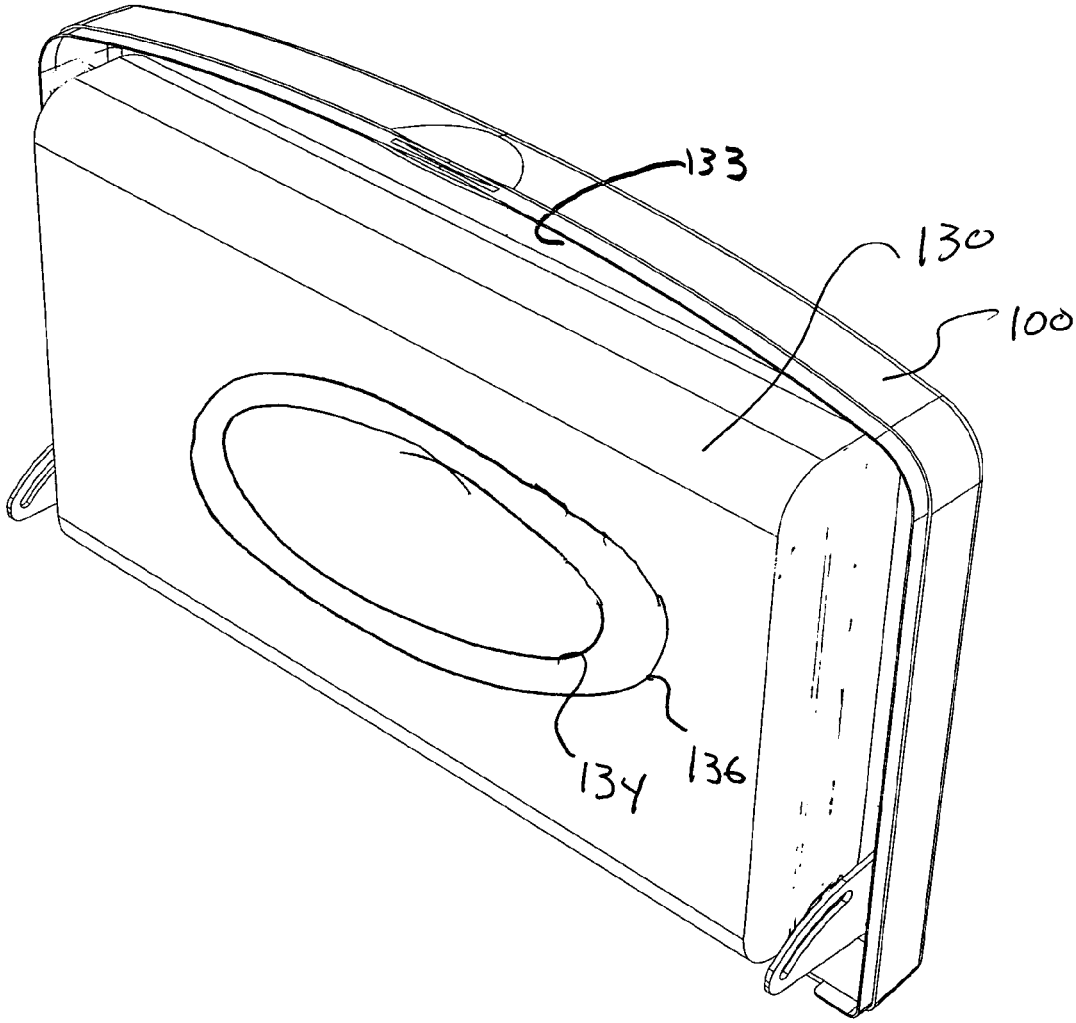
FIG. 1E shows the wipes dispensing system shown in FIG. 1C, with the refill door and dispensing lid removed for a more complete view of a pouch.
Figure 1F:
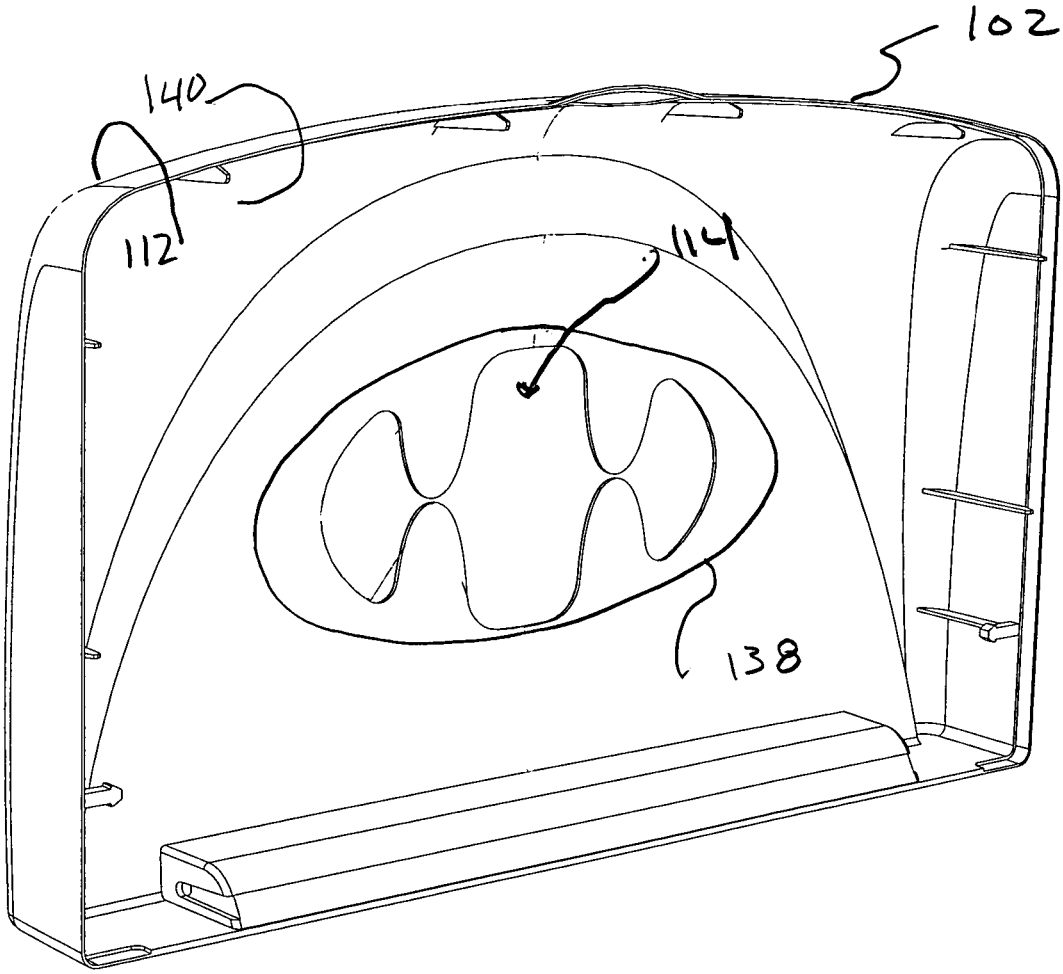
FIG. 1F shows a perspective view of the refill door shown in FIG. 1B, taken toward the refill door inside, surface.
Figure 16:
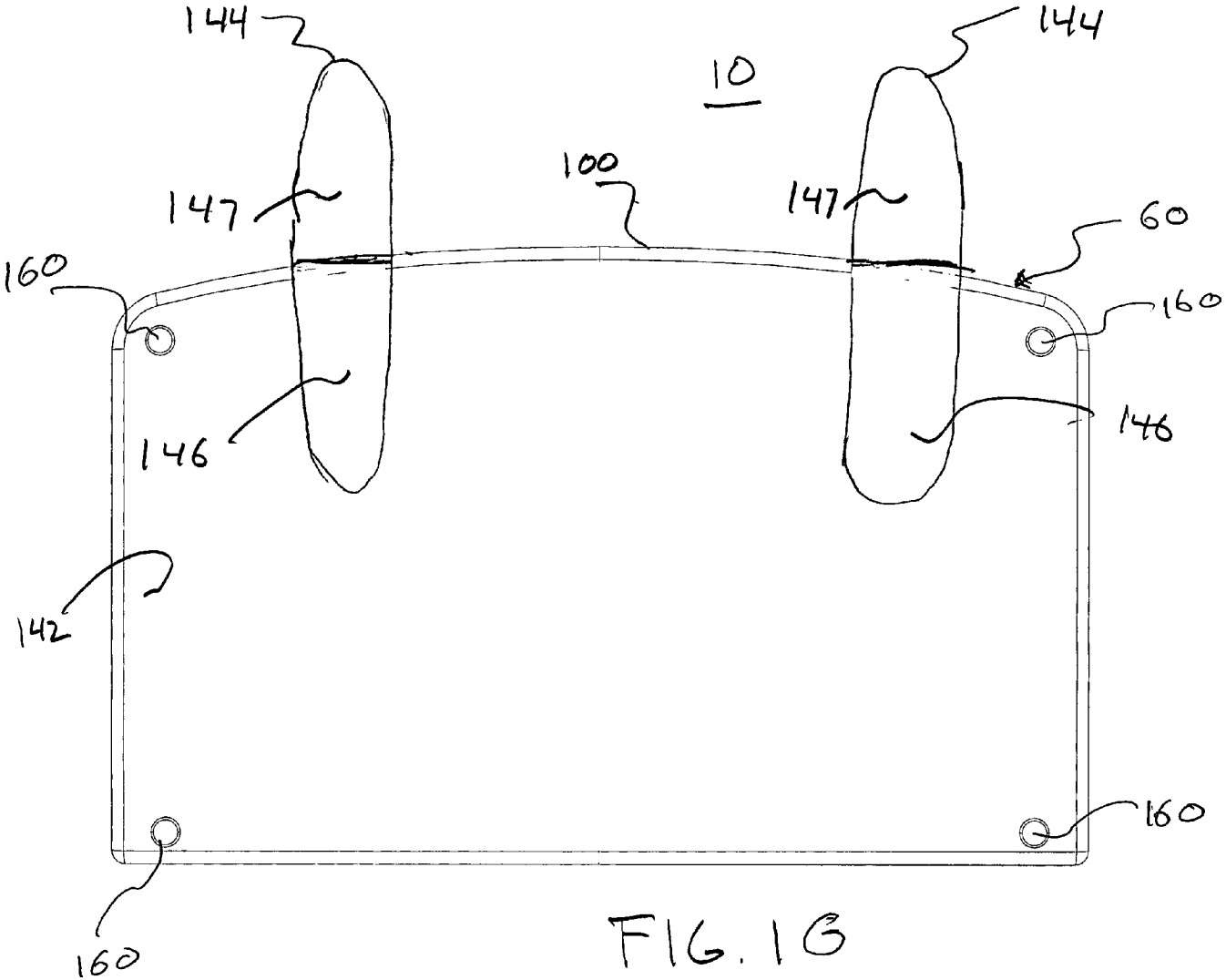

FIG. 1E shows wipes dispensing system 10 shown in FIG. 1C with refill door 102 and dispensing lid 108 removed for a more complete view of pouch 130. FIG. 1F shows a perspective view of refill door 102 taken toward a refill door inside surface 140 of refill door 102 opposite refill door outside surface 112 shown in FIG. 1A. Referring to FIG. 1E, pouch 130 includes a pouch aperture 134 at the front of pouch 130, through which wipes are removed. In one embodiment, pouch aperture 134 is advantageously configured such that a user may readily grasp the front wipe from the web or stack of wipes (not shown) contained in pouch 130 without the need to thread wipes through pouch aperture 134. A removable adhesive label (not shown) may cover pouch aperture 134 to prevent contamination of the wipes prior to use and to prevent dryout of wet or partially wetted wipes. In this embodiment, the adhesive label is removed before placement of pouch 130 between refill door 102 and base 100.

In one embodiment, pouch 130 includes a pouch fitment element 136 circumscribing pouch aperture 134. In this embodiment, pouch fitment element 136 is adapted to mate and cooperate with a refill door fitment element 138 (FIG. 1F) coupled to a refill door inside surface 140 opposite refill door outside surface 112 of refill door 102. When loading pouch 130 in this embodiment, a user aligns and abuttingly contacts pouch fitment element 136 on pouch 130 with refill door fitment element 138 on refill door 102 to secure pouch 130 to refill door 102. In this manner pouch 130 advantageously remains in place and substantially unmoved within the pouch space whenever a user extracts a wipe contained in pouch 130.

FIG. 1G shows a perspective-view of dispenser 60 taken toward a base outside surface 142 opposite base inside surface 133 (FIG. 1C) of base 100. Referring to FIG. 1G together with FIG. 1A, in one embodiment, wipes dispensing system 10 further includes one or more stretch release adhesive tapes 144, well known to those of skill in the art (See, for example, U.S. Pat. No. 6,569,521 B1 by Sheridan et al.) Dispenser 60 is attached to a mounting surface S (FIG. 1A) by means of stretch release adhesive tape 144.

When mounting dispenser 60 to mounting surface S, a first protective layer (not shown) is removed from stretch release adhesive tape 144 to expose a first adhesive layer (not shown) on one tape face. The first adhesive layer is placed in abutting contact with base outside surface 142 (see FIG. 1G) of base 100 to adhesively secure dispenser 60 to stretch release adhesive tape 144. A second protective layer (not shown) is removed from stretch release adhesive tape 144 to expose a second adhesive layer (not shown) on a second tape face opposite the first tape face of stretch release adhesive tape 144. The second adhesive layer is then placed in abutting contact with mounting surface S to adhesively attach stretch release tape-144 and dispenser 60 to mounting surface S.

Stretch release adhesive tape 144 may be selected to provide secure attachment of dispenser 60 to mounting surface S under a variety of conditions, such as, in cold, hot or humid environments. Stretch release adhesive tape 144 may also be selected to provide secure attachment of dispenser 60 to a variety of fixed surfaces, such as, painted surfaces, tile, glass, finished wood, drywall, etc. Further, dispenser 60 may be mounted on the top of horizontal surfaces, on vertical or slanted surfaces, or may be mounted to hang from the bottom of horizontal surfaces, such as for example, the under cabinet surfaces of kitchen or bathroom cabinets.

In one embodiment, a stretch release tab 146 of stretch release adhesive tape 144 extends beyond dispenser 60. Thus, when it is desired that dispenser 60 be removed from attachment to mounting surface S, stretch release tab 146 is pulled to release the second adhesive layer attaching dispenser 60 to mounting surface S. In another embodiment, stretch release tab is placed between base 100 and mounting surface S to hide stretch release tab 146 from view. In this embodiment, cutouts are supplied in base 100, through which stretch release tabs 146 may be accessed and pulled to release stretch release adhesive tape 144 whenever it is desired to remove dispenser 60 from mounting surface S. Typically, dispenser 60, mounted using stretch release adhesive tape 144, may be removed from mounting surface S without damage to mounting surface S or dispenser 60. A new stretch release adhesive tape 144 may then be used to mount dispenser 60 to another surface. In another embodiment dispenser 60 is releasably mounted to mounting surface S by other means, such as, for example, velcro tapes, suction cups, magnets, screws and removable double-sided foam tapes and the like.

In one embodiment, base 100 includes one or more pads 160 coupled to the back of base outside surface 142 where stretch release tape 144 is attached the base 100. As shown in FIG. 1G pads 160 are configured as cylindrical projections coupled at one end to base outside surface 142 and axially directed on a course away from base outside surface 142. The length of pads 160 is selected about equal to the thickness of stretch release tape 144. Without pads 160, dispenser 60 may rock about stretch release tape 144 as a pivot point. Pads 160 act as additional points defining back outside surface 142, thereby precluding rocking pivotal motion of dispenser 60 as wipes are dispensed. Other shapes for pads 160 are possible.

Figure 2:
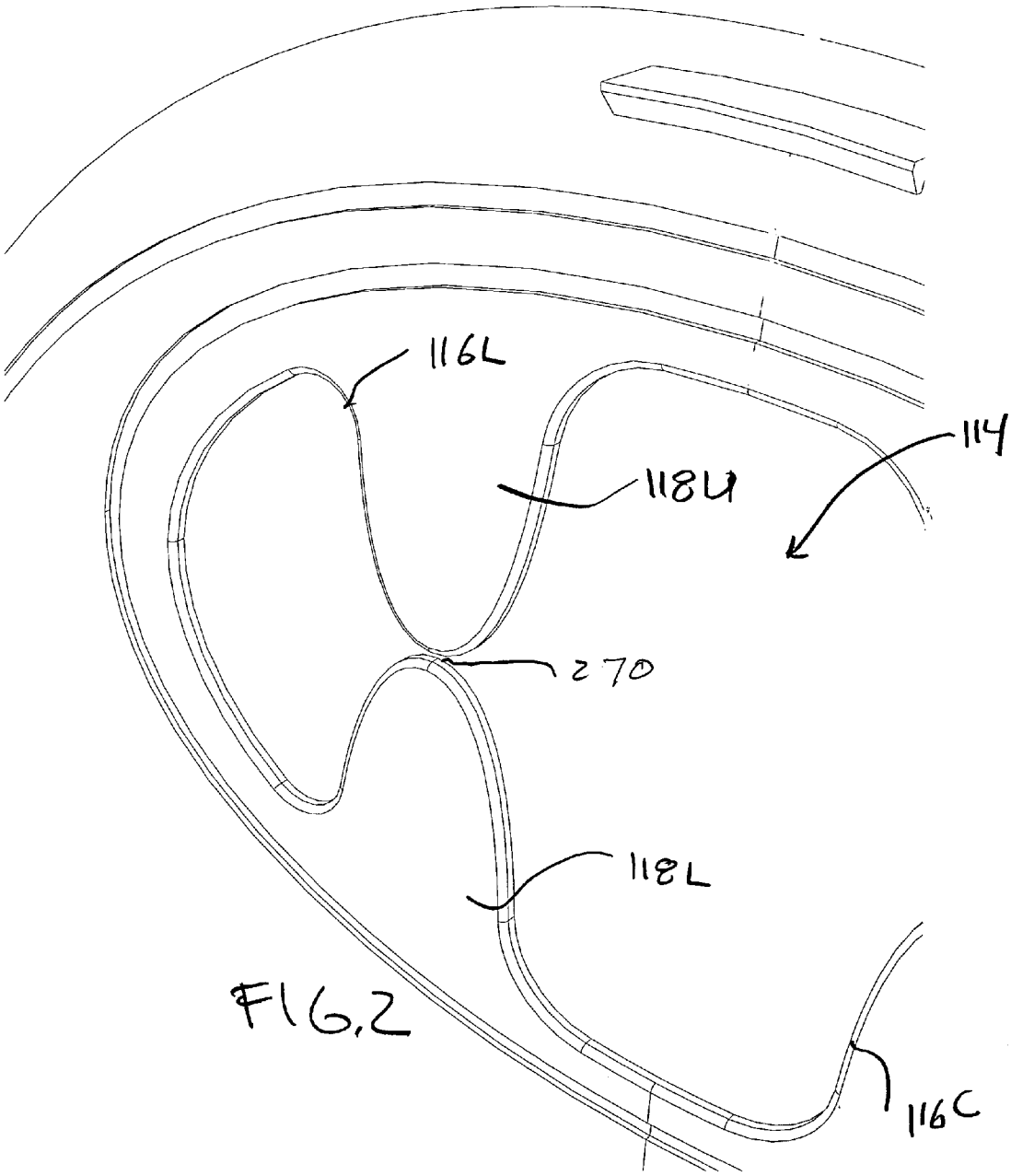
FIG. 2 is a close-up view of the portion of FIG. 1B circled in dotted line, showing a corresponding upper gripper and lower gripper set.

FIG. 2 shows a close-up view of the portion of FIG. 1B circled in dotted line as 2', showing a corresponding upper gripper 118U and lower gripper 118L set. Referring to FIGS. 1B and 2 together, opposing upper gripper 118U and lower gripper 118L define a gap 270. After pouch 130 is placed in the pouch space, the front wipe of pouch 130 is grasped through center lobe 116C of refill door aperture 114. As the wipe is extracted, the wipe threads through gap 270 and contacts one or both of upper gripper 118U and lower gripper 118L. Thus, a frictional force resisting the extraction of the wipe is generated as the wipe is further extracted in contact with upper gripper 118U and lower gripper 118L.

As described above, stacked wipes may be made to "pop-up" when the resisting frictional force generated by upper gripper 118U and lower gripper 118L is sufficient to avoid "roping" of the interleaved wipes. Further, for a roll of perforated wipes, by threading the web of perforated wipes through gap 270, singulation of wipes at the wipes separation perforations may be accomplished. In one embodiment, the resisting force generated by upper gripper 118U and lower gripper 118L at gap 270 is about 2 pounds force. However, it is envisioned that more or less resisting force may be attained using the present invention and the desired dispensing properties of the wipes, dispenser 60 and the wipes dispensing system 10.

The embodiments of the wipes dispensing system of the present invention are illustrated in detail in the context of a mountable wipes dispenser and a flexible wipes pouch. The skilled artisan will readily appreciate, however, that the invention can be carried out by different equipment, materials and devices, and that various modifications, both as to the equipment and operating procedures, can be accomplished without departing from the scope of the invention itself. The materials, structures, and methods disclosed herein will have application in a number of other contexts where convenient and easy dispensing of single sheets of substrate material is desirable.

What is claimed is:

1. A wipes dispensing system comprising:

a dispenser comprising:

a base, said base having a base inside surface, and a base outside surface opposite said base inside surface;

a refill door coupled to said base, said refill door having a refill door inside surface, a refill door outside surface opposite said refill door inside surface, and a refill door aperture through said refill door;

a dispensing lid coupled to said refill door, said dispensing lid having a dispensing lid inside surface and a dispensing lid outside surface opposite said dispensing lid inside surface; and wherein said base and said refill door define a pouch space when said refill door is placed in a closed relationship with said base;

a pouch having a left lateral side and a right lateral side within said pouch space wherein the pouch includes a pouch slider on each of the left and right lateral sides of the pouch slideably engaged with a pair of tracks on the base inside surface; and a mounting element coupled to a said base outside surface for attaching said dispenser to a mounting surface.

2. The wipes dispensing system of claim 1 wherein said refill door is pivotably coupled to said base.

3. The wipes dispensing system of claim 2 further comprising a living hinge pivotably coupling said refill door to said base.

4. The wipes dispensing system of claim 3 wherein said refill door, said base, and said living hinge are integrally formed.

5. The wipes dispensing system of claim 1 wherein said dispensing lid is pivotably coupled to said refill door.

6. The wipes dispensing system of claim 1 wherein said dispenser comprises plastic selected from the group consisting of PP, HDPE, PET, PS, ABS, and other engineered plastics.

7. The wipes dispensing system of claim 1 wherein said mounting element comprises stretch release adhesive tape.

8. The wipes dispensing system of claim 7 further comprising a cut-out in said base for accessing a stretch release tab of said stretch release adhesive tape.

9. The wipes dispensing system of claim 7 further comprising one or more pads coupled to said base outside surface, said pads having a length about equal to the thickness of said stretch release adhesive tape.

10. The wipes dispensing system of claim 1 wherein said pouch comprises one or more wipes.

11. The wipes dispensing system of claim 1 wherein one or more lateral edges of said pouch is gusseted.

12. The wipes dispensing system of claim 1 wherein said one or more wipes comprise a stack of interleaved wipes.

13. The wipes dispensing system of claim 1 wherein said pouch further comprises a pouch aperture for accessing said one or more wipes, said pouch aperture being covered by a removable adhesive label for protecting said wipes from the outside environment.

14. The wipes dispensing system of claim 1 wherein said wipes are selected from the group consisting of dry wipes, wet wipes, and partially wetted wipes.

15. The wipes dispensing system of claim 1 further comprising:

a refill door latch hook coupled to said base;

a refill door latch contact coupled to said refill door; and wherein said refill door latch hook is adapted to abuttingly contact and cooperate with said refill door latch contact to releasably lock said refill door with said base whenever said refill door is positioned in a closed relationship with said base.

16. The wipes dispensing system of claim 1 further comprising:

a dispensing lid latch hook coupled to said refill door;

a dispensing lid latch contact coupled to said dispensing lid; and wherein said dispensing lid latch hook is adapted to abuttingly contact and cooperate with said dispensing lid latch contact to releasably lock said dispensing lid with said refill door whenever said dispensing lid door is positioned to established a closed relationship with said refill door.

17. The wipes dispensing system of claim 1 further comprising:

one or more grooves formed as indentations into said refill door inside surface;

one or more corresponding rings formed as ridges projecting from said dispensing lid outside surface;

wherein each of said one or more grooves abuttingly contacts, mates and cooperates with a corresponding one of said one or more rings to form one or more interfaces; and wherein said interfaces seal said refill door aperture from the outside environment when said dispensing lid is in a closed relationship with said refill door.

18. The wipes dispensing system of claim 1 further comprising an refill door holder comprising:

a guide having a slot, said guide being coupled to said base inside surface; and a pin coupled to said refill door inside surface wherein said pin passes through and beyond said slot of said guide, and;

wherein said refill door holder limits the extent to which said refill door pivots open relative said base.

* * * * *